United States Patent [19]

Stevens

[11] Patent Number: 5,013,024

[45] Date of Patent: May 7, 1991

[54] VERTICALLY ADJUSTABLE STACK FEED MECHANISM

[76] Inventor: Robert E. Stevens, 218 N. Adams, Westmont, Ill. 60559

[21] Appl. No.: 399,252

[22] Filed: Aug. 28, 1989

[51] Int. Cl.[5] ..... B65H 3/62; B65H 1/06

[52] U.S. Cl. ..... 271/146; 271/35; 271/160; 271/167; 271/171; 271/262

[58] Field of Search ..... 414/795.7, 797.4, 797.6; 271/35, 110, 131, 138, 144, 145, 146, 148, 153, 154, 160, 162, 165, 167, 169, 171, 262

[56] References Cited

U.S. PATENT DOCUMENTS

| | | | |
|---|---|---|---|
| 3,545,741 | 12/1970 | Porth | 271/146 |
| 3,871,642 | 3/1975 | Mariaux et al. | 271/167 |
| 3,960,373 | 6/1976 | Pacholok | 271/131 |
| 4,436,469 | 3/1984 | Kelly | 271/171 |
| 4,884,797 | 12/1989 | Svyatsky | 271/160 |

FOREIGN PATENT DOCUMENTS

| | | | |
|---|---|---|---|
| 227169 | 5/1963 | Austria | 414/797.6 |

OTHER PUBLICATIONS

Swanson, "Sheet Separation by Vibration", *Xerox Disclosure Journal,* vol. 1, No. 9/10, Sep./Oct. 1976.

*Primary Examiner*—Robert P. Olszewski
*Assistant Examiner*—Steven Rimo
*Attorney, Agent, or Firm*—David C. Brezina

[57] ABSTRACT

A feed magazine for feeding items for an envelope insertion apparatus is adjustable along three axes and includes a resiliently mounted adjustable floor plate which permits tilting adjustment about a lateral axis, and includes a jam detector for signaling misfeeds.

9 Claims, 3 Drawing Sheets

VERTICALLY ADJUSTABLE STACK FEED MECHANISM

FIELD OF THE INVENTION

This invention relates to mechanisms or hoppers for feeding materials to automatic envelope processing machines which may be adjusted to handle groups of materials for insertions of varied thickness ranging from folded sheets to multiple leaf booklets.

DESCRIPTION OF THE PRIOR ART

The invention provides an improved accessory for automated envelope insertion machines. These automated machines have various stations where materials designed to be included in mass mailings, such as periodic financial statements, credit card billings and merchandise solicitations. The automated machines insert the envelope contents into the envelopes and prepare them for folding, sealing, postage metering and mailing or various combinations of these activities.

Current hopper devices used in connection with these machines have limited utility in that they are only adjustable along the two horizontal axes. The mailings, typically comprise rectilinear materials No method of vertical adjustment is typically provided for groups of materials having varying thickness, or surface friction, thus from one job to the next, machine setup efficiency is greatly limited.

Several patents address themselves to solutions of a more complex and cumbersome nature than the instant invention. U.S. Pat. No. 4,667,457 issued to Rogovein with angled, upwardly extending adjustable fingers uses a hopper for containing envelopes of differing horizontal dimensions. This does not address handling batches or stacks of materials with thicknesses that vary from other batches.

U.S. Pat. No. 4,506,874 issued to Preisig addresses thickness variation in such materials as stacks of corrugated box blanks by adding a step to the operation of pressing a pile of materials while manually loading a new batch of sheets. This does not consider thickness variation during continuous automatic high speed feed operations without manual intervention. This appears related to a loading operation for a container fabricating folding and gluing machine dealing with the loading of compressible materials rather than with problems of automatic feed.

U.S. Pat. No. 3,393,494 issued to Duby. This Patent addresses problems in packaging books for shipment. Duby's books appear to be predominantly the traditional equally dimensioned printed and bound books of text and graphic material. Applicant's invention is directed to books only in so far as multiple leaf stapled collections of materials such as coupons, or cards are assembled in a grouping referred to as a book. Doby includes adjustment for varying horizontal dimensions only, with books dealing with books lying with their spines horizontal on a conveyor and thus deals with a transverse dimension rather than the vertical dimension referred to in the instant application as "thickness".

SUMMARY OF THE INVENTION AND OBJECTS OF THE INVENTION

One advantage of my improved hopper is that it is easily adjustable to permit adaptation to batches of materials of varying thickness.

Another advantage of my invention is that adjustment of the slope of the feed material is possible to permit adjustment for difficult feed situation such as materials that vary in thickness from one end to the other and materials with projections such as staples from one or both surfaces or other factors which effect the friction between surfaces.

Another advantage of my invention is that a single hopper or magazine may be adjusted for varying tasks eliminating the need for multiple custom hoppers or magazines and increasing the utility of a given equipment inventory.

Another advantage is that set-up time for differing batch jobs is reduced and amplified.

Another advantage is that replacement of hopper floor surfaces when worn or damaged is facilitated.

Additional objects and advantages of the invention will become apparent and will be better understood from the following description and the accompanying drawings.

DESCRIPTION OF THE PREFERRED EMBODIMENT

Figure 1:
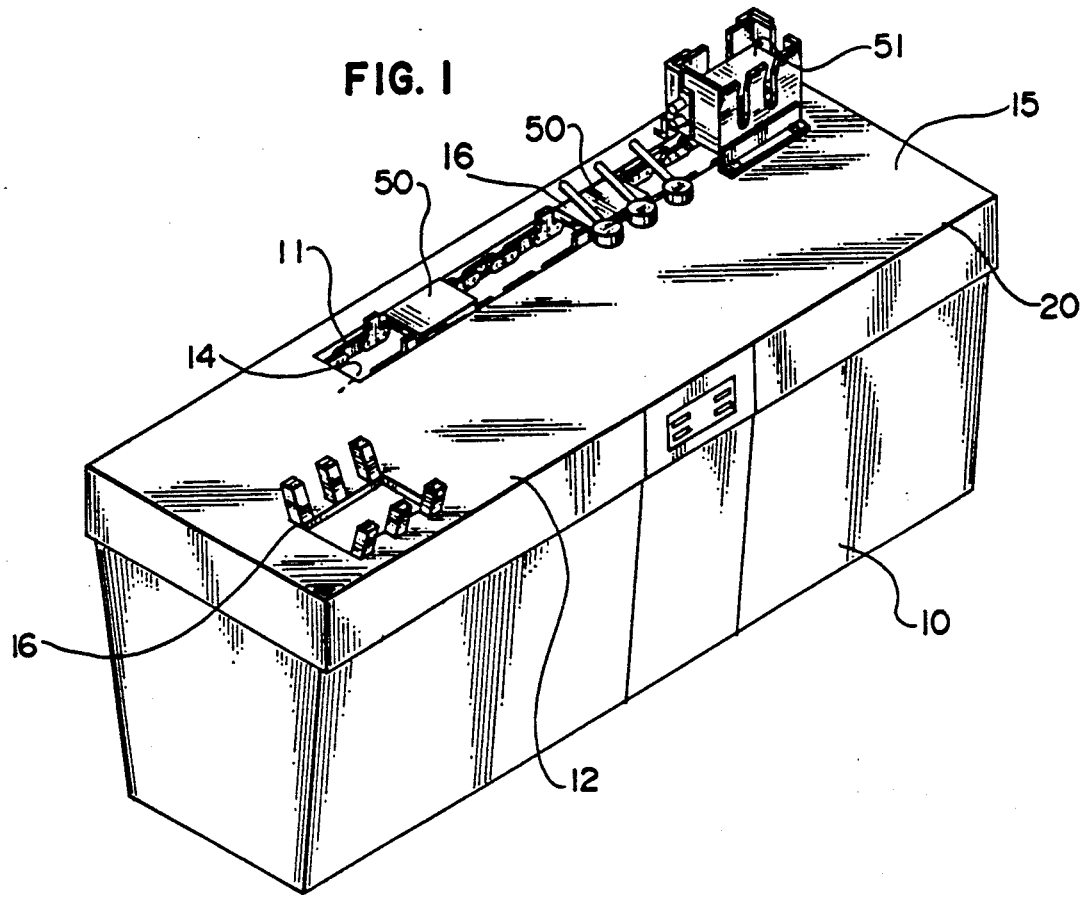
FIG. 1 is a perspective view of an envelope insertion machine incorporating the invention.

FIG. 1 shows an envelope inserting machine (10) having a track (11) and a feed chain or conveyor (12) driven by sprocket assemblies (14) from an associated power source (not shown). The machine base (15) is adapted for the placement of various stations (16) for the handling of materials and munipulation thereof. The invention relates to a specific hopper or magazine (20) which enables a stack of books (51) or insertions to be fed as individual items for sequential or serial insertion into envelopes.

Figure 2:
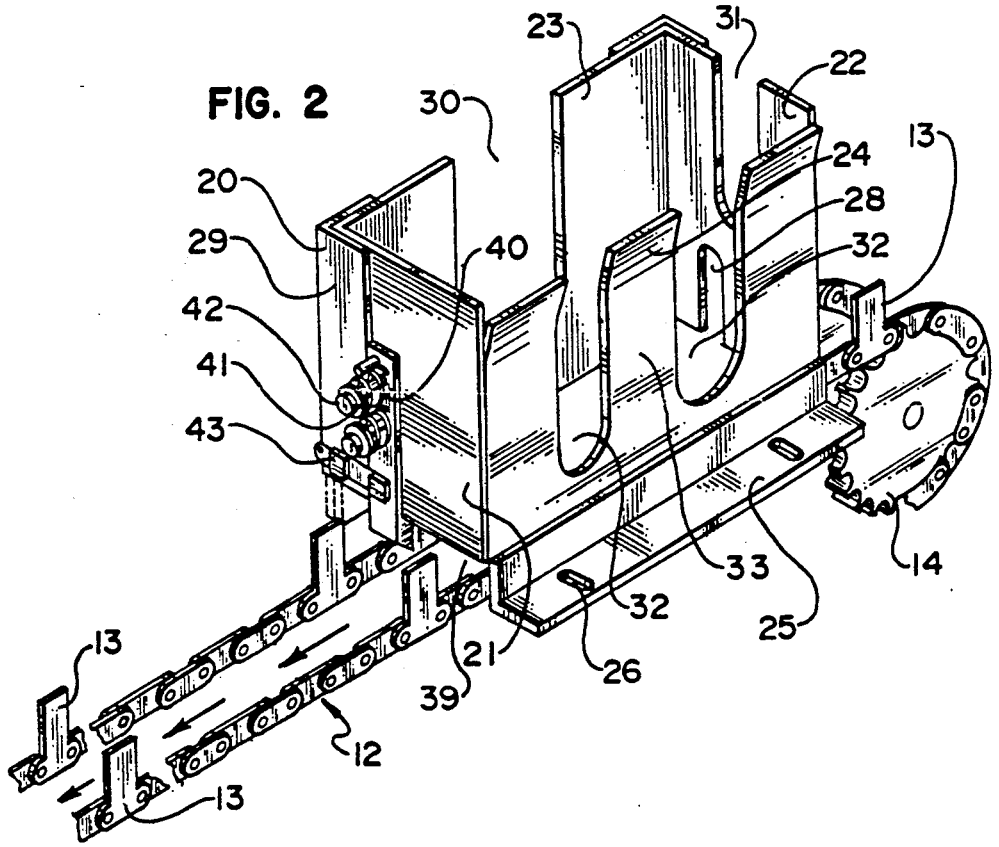
FIG. 2 is a perspective view of the invention.

FIG. 2 shows the hopper or magazine (20) with a feed chain (12) passing thereunder. The feed chain has push pins (13) carried thereon at spaced intervals. The hopper has an outlet or egress end plate (21) a slotted end plate (22) a fixed side guide (23) and an adjustable side guide or alignment structure (24). The adjustable side guide is attached to the guide mount (25) having adjusting slots (26) and a selected adjustment maintained by fasteners (27).

The chain (12) is driven by sprocket (14) and the push pins pass through slots (28) in the end plate (22). This end plate also has an upwardly opening slot (31) to facilitate hand-insertion into the hopper for handling of the materials placed therein. The fixed side guide (23) also has an upwardly opening slot (30) and the adjustable side guide or alignment wall (24) has slots (32) defining a finger (24) between them.

The outlet end plate (21) is fixed to a bracket (29) maintaining the plate (21) in a raised position relative to the chain (12) defining an outlet or gate (39) at the bottom of the plate (21). An adjustable slide stop or block (40) is adjustably carried on the plate (21) and maintained in position by fasteners (42) extending through vertical slots and tensioned by springs (41).

The slide stop (40) is further fitted with a jam detector or sensor (43) which operates by closing an electrical circuit upon displacement of the slide stop or block (40) from its normal operating position.

Figure 3:
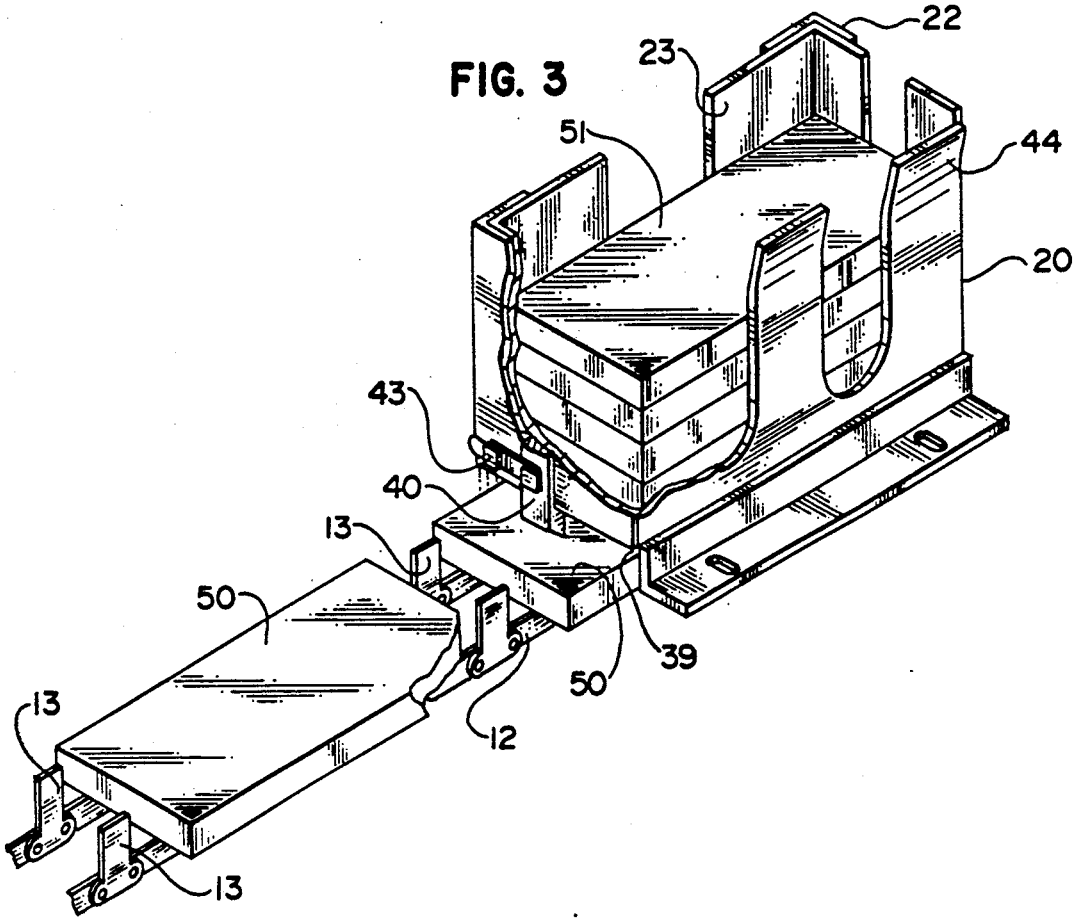
FIG. 3 is a perspective cut away view of the invention.

FIG. 3 shows the hopper or magazine (20) loaded with a stack (51) of books, materials or insertions to be sequentially or serially incorporated in the line of the envelope inserter. Individual insertions (50) (FIG. 3) are conveyed from the bottom of the stack (51) as the chain or conveyor (12) travels thereunder and the pusher pins (13) engage the bottom book (50).

Figure 4:
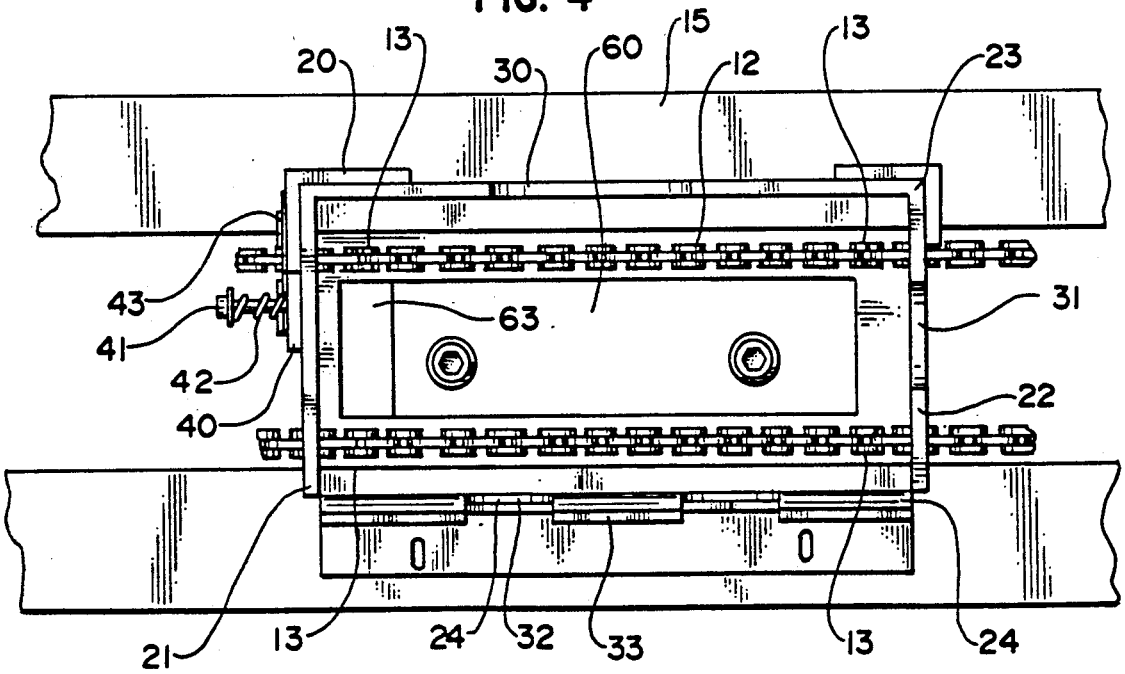
FIG. 4 is a plan view of the invention in place on an envelope insertion machine.

FIG. 4 shows a machine base (15) and conveyor chains (12) in relation to the hopper or magazine and particularly the arrangement of the pusher pins (13) extending upward from the chains such that they are permitted to pass on either side of the support plate (60) while the books have sufficient clearance to extend over the edges of the plate. The angled exit end (63) and adjustment bolts for screws (67) are visible in FIG. 6. These screws elevate or lower the stack in FIG. 3 with reference to the exit gate (39) also in FIG. 3 for horizontal alignment to permit the lowermost item (50) to discharge from the hopper.

Figure 5:
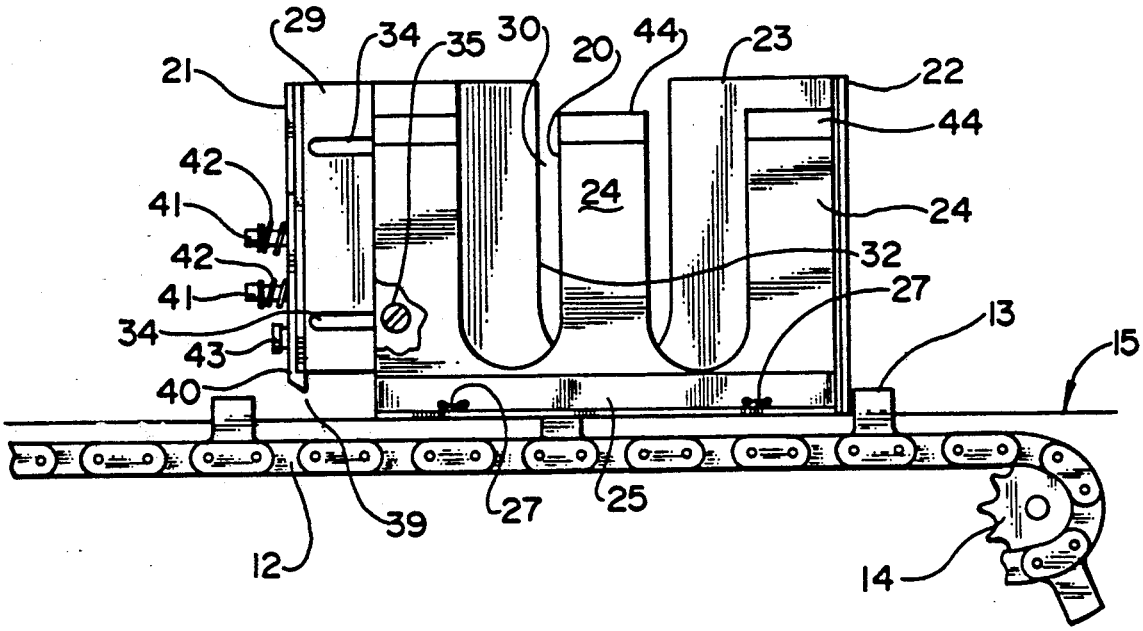
FIG. 5 is an elevational view of the invention.

FIG. 5 is a side elevational view showing the arrangement of the hopper (20) and the chain (12). In this figure it can be seen that the adjustable side guide (24) has top angled portions (44) which increase the ease of loading while the adjustable side guide (24) itself is substantially vertical and relatively closely corresponds to one side of the generally rectilinear books which may be loaded therein. This view also shows longitudinal adjustment slots (34) in bracket (29) which permits selective movement of the end plate (21) which is held in place through appropriate fastening means (35) such as screws. Also shown in this view is the outlet adjustable slide stop (40) biased by the springs (42) and tensioned fasteners (41) against bracket and having a jam detector (43) which detects longitudinal movement of the block or stop (40) when through misalignment, due to stack friction or other causes results in the conveyor forcing the stack against the stop (40) displacing it. The locking fasteners (27) for adjusting the adjustable side guide (24) through displacement of the mount (25) are shown.

Figure 6:
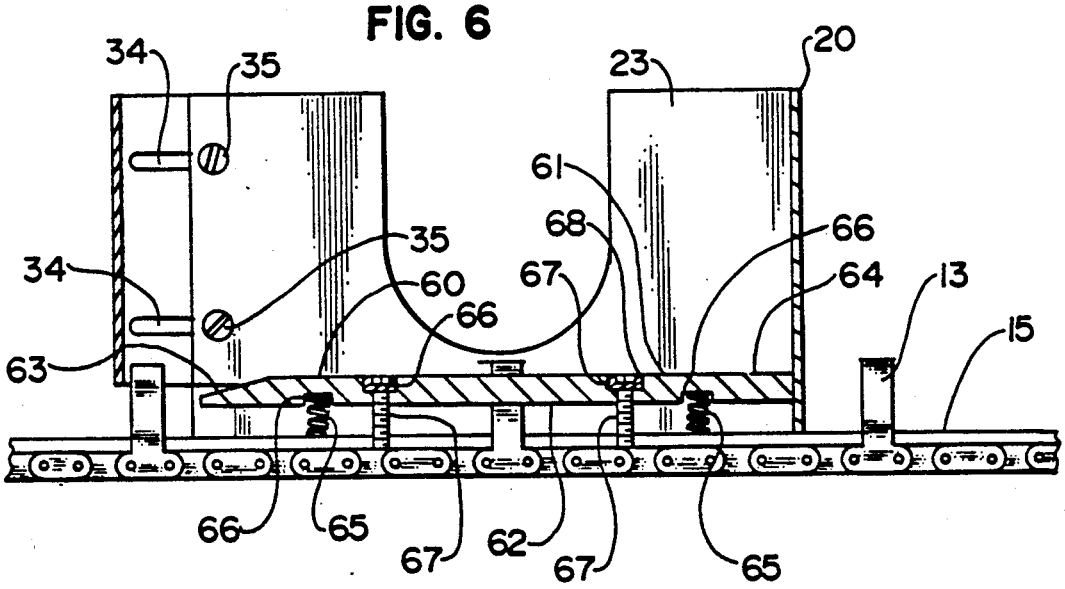
FIG. 6 is a sectional view of the invention.

FIG. 6 is a sectional view showing the adjustable supporting sole or floor plate (60) which permits vertical adjustment for various thickness of books, insertions or forms. The plate floor or piece (60) has a top surface (61), a support surface (62), an angled exit or egress end (63), and a squared end (64). The plate (60) is resiliently supported by partially compressed coil springs (65) compressed in a downwardly opening blind bore (66) in the bottom of the plate and the base (15) of the machine. The upward movement is limited and adjusted by two independent adjustment screws (67) threaded into the base 15 engaging counter-bored seats (68) as seen in FIG. 6 so that a substantially flat surface (61) is provided to effect sliding of books.

The resilient mounting and adjustment arrangement permits a wide range of fine-tunning for specific insertion traits, as a damper effect in operation and a flexibility in oscillation as insertions are removed and the stack falls downward. These contribute to reduced friction between insertions, jams.

In accordance with my invention, I claim:

1. A magazine for use in connection with envelope insertion machines with a base, the machine having a continuous conveyor to feed items from a stack positioned in said magazine over said conveyor comprising:

said magazine having first and second end plates and side guides for maintaining said items in stacked arrangement, and being mounted on said base;

said first end plate having egress means for permitting the items to egress when driven by the conveyor;

said first end plate having means for longitudinal adjustment thereof to effect different spaces for exiting items of varying length from the magazine; means for adjusting one of said side guides transversely on said base for accommodating items of varying widths; a stack-supporting vertically adjustable floor piece being mounted on said base, said piece having two ends; means for selectively adjusting said piece being spaced in from each of said ends to adjust said piece to predetermined positions in alignment with reference to said end plates for accommodating passage therethrough of items of varied thicknesses;

said first and second plates having side passage means to permit movement of said conveyor therethrough to engage items stacked in the magazine upon said piece for conveyance through the egress means; means for resiliently supporting and upwardly biasing said floor piece relative to said base; adjustable stop means for limiting upward elevation of said floor piece and controlling the angular disposition of said floor piece towards the egress means.

2. The invention according to claim 1 and said egress means having control means for engagement with individual items to maintain sequential egress of the items and;

said control means having jam detection means for signaling item misfeeds.

3. A magazine for an automated envelope inserting machine having a base, and having a conveyor for serially supplying insertions of items from a stack positioned within said magazine, comprising:

said magazine having an end alignment wall and a side alignment structure for maintaining the stack in predetermined longitudinal and lateral disposition, said wall and structure being mounted on said base; an adjustable floor plate also mounted on said base, supporting said stack and disposing the bottom item of the stack in a substantially lateral plane; end gate means for permitting items to pass through an aperture defined thereby sequentially, and means for sequentially controlling the height of said aperture compatible with the items to pass therethrough; resilient members supporting said floor plate on said base for exerting upward pressure against the plate, and means for selectively vertically positioning the front and rear, or either, of the plate.

4. The invention according to claim 3 and said gate means including slide stop means for adjustably controlling passage of items and sensor means for signaling misfeeds, the end wall providing an opening of predetermined height through which items may pass;

said stop means being vertically adjustable with reference to the end wall and having a block portion for engagement of a second lowest item of the stack and clearance of the lowest item of the stack, said adjustment being provided by movement of the slide stop;

said sensor means transmitting an indication of misfeed when more than one insertion attempts to pass through the gate.

5. A magazine with ends and sides, mounted to the base of an insertion machine, for discharging items from a stack, the magazine including a support plate, also mounted on the base, comprising:

said magazine having an exit aperture and a conveyor moving therebeneath for individually discharging the items from the bottom of the stack through said aperture;

said plate being adapted to vibrate as the items in the stack fall thereon, as the lowermost items is removed, effecting the temporarily cleaving apart of said items to facilitate separation of the bottom item from the stack.

6. The invention according to claim 5, and means for vertically adjusting said support plate and accommodating tilting of said plate about a lateral axis;

said plate slidably supporting said items for disengagement therefrom.

7. A magazine with ends and sides, mounted to the base of an insertion machine, for discharging items from a stack, the magazine including a support plate, also mounted on the base, comprising:

said magazine having an exit aperture and a conveyor moving therebeneath for individually discharging the items from the bottom of the stack through said aperture;

said plate being adapted to vibrate as the items in the stack fall thereon, as the lowermost item is removed, effecting the temporarily cleaving apart of said items to facilitate separation of the bottom item from the stack; means for vertically adjusting said support plate and accommodating tilting of said plate about a lateral axis;

said plate slidably supporting said items for disengagement therefrom;

said adjusting means further comprising first and second resilient support means for supporting the plate above the base, and first and second screw means for interconnecting the plate and base means;

said first and second screw means being threadibly mounted near the first and second resilient support means for selective supporting of the plate with respect to the base.

8. A magazine with ends and sides, mounted to the base of an insertion machine, for discharging items from a stack, the magazine including a support plate, also mounted on the base, comprising:

said magazine having an exit aperture and a conveyor moving therebeneath for individually discharging the items from the bottom of the stack through said aperture;

said plate being adapted to vibrate as the items in the stack fall thereon, as the lowermost items is removed, effecting the temporarily cleaving apart of said items to facilitate separation of the bottom item from the stack; means for vertically adjusting said support plate and accommodating tilting of said plate about a lateral axis;

said plate slidably supporting said items for disengagement therefrom;

said adjusting means further comprising first and second resilient support means for supporting the plate above the base, and first and second screw means for interconnecting the plate and base means;

said first and second screw means being threadibly mounted near the first and second resilient support means for selective supporting of the plate with respect to the base;

said magazine end having a longitudinally adjustable vertical end plate defining an opening at its lower portion thereby providing said exit aperture.

9. The invention according to claim 8, and said end plate having a gate with an aperture and adjustment means for selectably vertically adjusting the gate aperture control for the thickness of items which are permitted to be discharged;

said end plate having means for detecting jams comprising a switch for signaling misfeeds by the displacement thereof upon the application of force from a plurality of contiguous items exceeding the selected thickness by said conveyor pushing on said items.

* * * * *